US007367997B1

(12) United States Patent
Isogawa

(10) Patent No.: US 7,367,997 B1
(45) Date of Patent: May 6, 2008

(54) ELECTRONIC ENCLOSURE FILTER FOR VERY SMALL SPACES

(75) Inventor: Katsushi Isogawa, Eagan, MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

(21) Appl. No.: 11/179,788

(22) Filed: Jul. 11, 2005

Related U.S. Application Data

(60) Provisional application No. 60/632,753, filed on Dec. 1, 2004, provisional application No. 60/587,631, filed on Jul. 12, 2004.

(51) Int. Cl.
*B03C 3/155* (2006.01)

(52) U.S. Cl. ..... 55/385.6; 96/68; 96/69; 96/134; 96/154; 360/97.02

(58) Field of Classification Search ..... 96/15, 96/17, 55, 68, 69, 66, 134, 154; 55/385.6; 360/97.02
See application file for complete search history.

(56) References Cited

U.S. PATENT DOCUMENTS 4,863,499 A * 9/1989 Osendorf ..... 96/134
5,030,260 A * 7/1991 Beck et al. ..... 96/139
5,367,417 A 11/1994 Brown et al.
5,447,695 A 9/1995 Brown et al.
5,538,545 A * 7/1996 Dauber et al. ..... 96/153
5,754,365 A 5/1998 Beck et al.
5,872,679 A 2/1999 Boigenzahn et al.
5,997,614 A * 12/1999 Tuma et al. ..... 96/4
5,997,618 A * 12/1999 Schneider et al. ..... 96/135
6,077,335 A * 6/2000 Schneider et al. ..... 96/135
6,214,070 B1 * 4/2001 Crowder et al. ..... 55/320
6,238,467 B1 * 5/2001 Azarian et al. ..... 96/135
6,285,524 B1 9/2001 Boigenzahn et al.
6,296,691 B1 * 10/2001 Gidumal ..... 96/17
6,395,073 B1 * 5/2002 Dauber ..... 96/134
6,475,269 B1 * 11/2002 Turner ..... 96/134
6,618,222 B1 9/2003 Watkins et al.
6,890,373 B2 * 5/2005 Nemoto et al. ..... 95/90
6,926,761 B2 * 8/2005 Johnson et al. ..... 96/135
6,936,093 B2 * 8/2005 Isogawa et al. ..... 96/55
6,940,687 B2 9/2005 Hong et al.
7,110,215 B2 9/2006 Hong et al.
7,125,433 B2 * 10/2006 Garikipati et al. ..... 55/385.6
7,130,149 B2 10/2006 Hong et al.
7,166,142 B2 * 1/2007 Tuma et al. ..... 55/385.6
7,291,208 B2 * 11/2007 Dauber et al. ..... 96/134
7,300,500 B2 * 11/2007 Okada et al. ..... 96/153
7,306,659 B2 * 12/2007 Gorton et al. ..... 96/134

(Continued)

FOREIGN PATENT DOCUMENTS

WO WO 01/97965 A1 * 12/2001

*Primary Examiner*—Richard L. Chiesa
(74) *Attorney, Agent, or Firm*—Pauly, DeVries, Smith & Deffner, L.L.C.

(57) ABSTRACT

The present invention is directed to an improved electronic enclosure filter for very small spaces, such as small disk drives. The filter includes an exposed electrostatic layer that functions to catch and retain particulate contamination within the filter. The filter can be placed within disk drive enclosures such that the electrostatic layer is in very close proximity to the rotating disk without causing excessive turbulence. The close proximity of the electrostatic layer to the disk creates relatively high levels of airflow over the electrostatic layer.

1 Claim, 1 Drawing Sheet

SECTION A-A

U.S. PATENT DOCUMENTS

2001/0000381 A1* 4/2001 Tuma et al. ..... 95/90
2003/0218828 A1* 11/2003 Hong et al. ..... 360/97.02
2003/0218829 A1* 11/2003 Hong et al. ..... 360/97.02
2003/0231424 A1* 12/2003 Hong et al. ..... 360/97.02
2004/0163367 A1* 8/2004 Cogar et al. ..... 55/385.6
2004/0168575 A1* 9/2004 Isogawa et al. ..... 96/134
2004/0231518 A1* 11/2004 Johnson et al. ..... 96/134
2004/0261378 A1 12/2004 Garikipati et al.
2005/0139078 A1* 6/2005 Tuma et al. ..... 96/134
2005/0185327 A1 8/2005 Voights et al.
2006/0032371 A1 2/2006 Dauber et al.
2006/0032372 A1 2/2006 Dauber et al.
2006/0081128 A1 4/2006 Ball et al.

* cited by examiner

SECTION A - A

ELECTRONIC ENCLOSURE FILTER FOR VERY SMALL SPACES

CROSS-REFERENCE TO RELATED APPLICATIONS

This application claims the benefit under 35 USC 119(e) of U.S. provisional applications 60/587,631 filed on Jul. 12, 2004 and 60/632,753 filed on Dec. 1, 2004.

BACKGROUND

A need exists for improved filters for use in electronic enclosures. In particular, a need exists for improved filters for use in small electronic enclosures, such as the small disk drives used in personal media players, such as the Apple iPod.

SUMMARY OF THE INVENTION

The present invention is directed to an improved electronic enclosure filter for very small spaces, such as small disk drives. The filter includes an exposed electrostatic layer that functions to catch and retain particulate contamination within the filter. The filter can be placed within disk drive enclosures such that the electrostatic layer is in very close proximity to the rotating disk without causing excessive turbulence. The close proximity of the electrostatic layer to the disk creates relatively high levels of airflow over the electrostatic layer.

Other features and advantages of the invention will be apparent from the following detailed description of the invention and the claims. The above summary of principles of the disclosure is not intended to describe each illustrated embodiment or every implementation of the present disclosure. The detailed description that follows more particularly exemplifies certain embodiments utilizing the principles disclosed herein.

BRIEF DESCRIPTION OF THE DRAWINGS

The invention will be more fully explained with reference to the following drawings.

Figure 1:
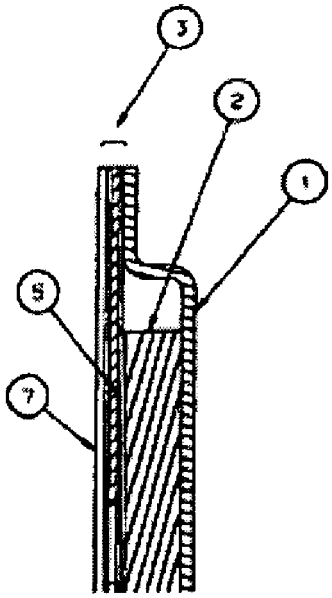
FIG. 1 a cross section of a filter made in accordance with the present invention.

While principles of the invention are amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure and claims.

DETAILED DESCRIPTION

Filters made in accordance with the present invention provide multiple functions in an adsorbent breather filter.

Beside the standard functions of controlling passage of particulate contamination into the enclosure and control of chemical contaminants into and within said enclosure, this filter has added functionality of catching and holding particulate contamination that is present within the enclosure. As disk drives have become more miniaturized, the space allowed for filtration has been reduced significantly. As a result, new ways of performing some of the functions have been created to meet the ongoing needs for filtration with different filtration principles and constructions.

As noted above, the present invention includes an electrostatically charged filtration layer on the surface of an adsorbent breather filter which, when applied in the very small disk drives, will attract and hold particulate matter circulating in the drive. This invention is useful in smaller drives with smaller clearances that cause the air containing the particulate contaminant to come close enough for the electrostatic forces to capture them. The shape of flat adsorbent breather filter allows contaminated air to enter the zone where the electrostatic forces are stronger than the Newtonian forces propelling the particulate contamination.

Figure 2:
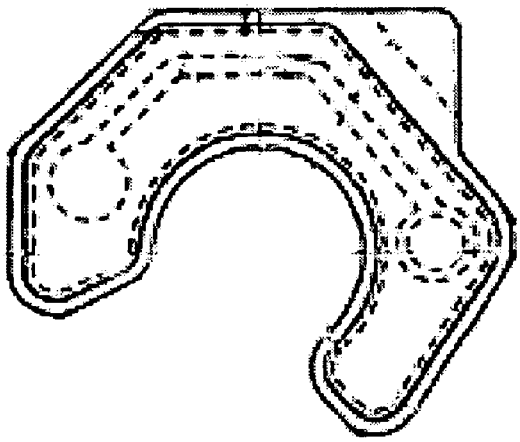
FIG. 2 is a plan view of a filter made in accordance with an embodiment of the invention.

In reference now to FIG. 1, a cross section of a filter made in accordance with the present invention is shown. The outer layer 1 of the filter (exposed to the interior of the electronic enclosure) includes an electrostatic layer, and also generally contains a filter material (such as a PTFE membrane). An adsorbent material 2 is positioned inside the filter, and typically contains activated carbon. The bottom of the filter 3 typically includes a diffusion channel 5 and a release liner 7. A plan view of a filter made in accordance with the invention is shown in FIG. 2, showing the diffusion channel in the interior of the filter in dashed lines (because it is not visible from the exterior.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A filter for use in electronic enclosures, the filter comprising:

an adsorbent material;

a filter material comprising a PTFE membrane and covering at least a portion of the adsorbent material;

the filter having a bottom which includes a release liner and a diffusion channel;

an electrostatic material; and the diffusion channel located within an interior of the filter and in fluid communication with the adsorbent material;

wherein the electrostatic material at least partially covers the adsorbent material; and wherein the electrostatic material is configured to be exposed to the interior of the electronic enclosure.

* * * * *